US010966520B2

(12) United States Patent
Chen

(10) Patent No.: US 10,966,520 B2
(45) **Date of Patent: *Apr. 6, 2021**

(54) CABINET LOCKING DEVICE

(71) Applicant: MARTAS PRECISION SLIDE CO., LTD., New Taipei (TW)

(72) Inventor: Wan-Lai Chen, New Taipei (TW)

(73) Assignee: MARTAS PRECISION SLIDE CO., LTD., New Taipei (TW)

( * ) Notice: Subject to any disclaimer, the term of this patent is extended or adjusted under 35 U.S.C. 154(b) by 260 days.

This patent is subject to a terminal disclaimer.

(21) Appl. No.: 16/248,702

(22) Filed: Jan. 15, 2019

(65) Prior Publication Data

US 2020/0221869 A1 Jul. 16, 2020

(51) Int. Cl.

| | |
|---|---|
| ***A47B 88/473*** | (2017.01) |
| ***A47B 88/919*** | (2017.01) |
| ***E05B 65/462*** | (2017.01) |
| ***E05B 65/46*** | (2017.01) |
| ***A47B 67/04*** | (2006.01) |

(52) U.S. Cl.

CPC ..... *A47B 88/473* (2017.01); *A47B 88/919* (2017.01); *E05B 65/46* (2013.01); *E05B 65/462* (2013.01); *A47B 67/04* (2013.01)

(58) Field of Classification Search

CPC ..... A47B 67/04; A47B 88/919; A47B 88/473; E05B 65/462; E05B 65/46; E05B 65/466

See application file for complete search history.

(56) References Cited

U.S. PATENT DOCUMENTS

| | | | | |
|---|---|---|---|---|
| 2,559,579 A * | 7/1951 | Abrahamson | E05B 65/462 312/219 |
| 3,900,236 A * | 8/1975 | Goulish | E05B 65/464 312/217 |
| 5,427,445 A * | 6/1995 | Mitchell | E05B 53/003 312/215 |
| 5,802,891 A * | 9/1998 | Kahara | E05B 65/462 312/333 |
| 5,946,953 A * | 9/1999 | Feldpausch | E05B 65/462 312/219 |
| 6,186,606 B1 * | 2/2001 | Krei | E05B 65/46 312/221 |
| 6,217,139 B1 * | 4/2001 | Henriott | A47B 21/06 312/219 |

(Continued)

*Primary Examiner* — Daniel J Rohrhoff

(74) *Attorney, Agent, or Firm* — Li & Cai Intellectual Property (USA) Office

(57) ABSTRACT

A cabinet locking device includes a cabinet body, a plurality of movable storage devices, a plurality of locking devices, and a driving device. The driving device is interlocked with the locking devices via a plurality of drawstrings. Each locking device includes a sliding member, an interference member disposed on the sliding member, and a restriction mechanism for guiding the sliding member. The driving device can drive the sliding member to move to an engaging portion or a released position. When the sliding member is moved to the engaged position, the interference member interferes with an engaging portion of the corresponding movable storage device such that the movable storage device cannot be opened. When the sliding member is moved to the released position, the interference member does not interfere with the engaging portion such that the movable storage device can be opened.

10 Claims, 10 Drawing Sheets

(56) References Cited

U.S. PATENT DOCUMENTS

| | | | | |
|---|---|---|---|---|
| 10,273,721 | B1 * | 4/2019 | Chen | E05B 63/143 |
| 10,470,572 | B1 * | 11/2019 | Chen | A47B 88/473 |
| 10,697,204 | B1 * | 6/2020 | Chen | E05C 19/10 |
| 2006/0138912 | A1 * | 6/2006 | Chen | E05B 65/462 312/217 |
| 2012/0068590 | A1 * | 3/2012 | Chen | E05B 65/464 312/333 |
| 2016/0303732 | A1 * | 10/2016 | Tam | E05B 37/02 |

* cited by examiner

CABINET LOCKING DEVICE

FIELD OF THE DISCLOSURE

The present disclosure relates to a cabinet locking device, and more particularly to a cabinet locking device used in storage cabinets such as chests of drawers or information cabinets.

BACKGROUND OF THE DISCLOSURE

To avoid being arbitrarily opened, in a conventional cabinet, such as a chest of drawers or an information cabinet, a locking device is usually arranged to control the opening and closing of the drawer or the cabinet. The locking device generally includes a lock core, a plurality of latching mechanisms, and a transmission mechanism. However, the configuration of the latching mechanism of the locking device is quite complicated, and the transmission mechanism of the locking device is bulky, thus occupying the accommodation space inside the cabinet and complicating the configuration of the cabinet.

The above drawbacks cause various inconveniences in the use of the locking device of the conventional cabinet. In this regard, the present disclosure provides a cabinet locking device that can overcome the aforementioned drawbacks.

SUMMARY OF THE DISCLOSURE

In response to the above-referenced drawbacks, the present disclosure provides a cabinet locking device having a construction and a configuration different from that of the conventional cabinet locking device.

In one aspect, the present disclosure provides a cabinet locking device including a cabinet body, at least a movable storage device, at least a locking device, and a driving device. An interior of the cabinet body has an accommodating space, a front side of the cabinet body has an opening end, and each of the left and right sides of the cabinet body includes a side plate. Two side portions of the movable storage device that are adjacent to the two side plates are respectively mounted to inner side walls of the two side plates via two slide rails. The movable storage device is capable of moving along a first direction to a closed position by the guiding of the two slide rails such that the movable storage device is disposed inside the accommodating space and capable of moving along a second direction opposite to the first direction to an open position by the guiding of the two slide rails such that the movable storage device protrudes from the accommodating space. At least one of the two side portions of the movable storage device that are adjacent to the two side plates has at least one engaging portion. The locking device is disposed inside the cabinet body and adjacent to the engaging portion. The locking device includes a sliding member, an interference member connected to the sliding member, and a restriction mechanism configured to limit a displacement path of the sliding member. The sliding member is configured to be guided by the restriction mechanism to move to an engaged position along a third direction perpendicular to the first direction or the second direction; or the sliding member is configured to be guided by the restriction mechanism to move to a released position along a fourth direction opposite to the third direction. The position of the interference member is arranged at a position where the interference member interferes with the engaging portion when the movable storage device is moved to the closed position and the sliding member is moved to the engaged position; or is arranged at a position where the interference member does not interfere with the engaging portion when the sliding member is moved to the released position. The driving device includes a traction mechanism and at least a drawstring, and the drawstring is interlocked with the traction mechanism and the sliding member. The traction mechanism is configured to drive the sliding member to move along the third direction or the fourth direction via the drawstring, such that the sliding member moves to the engaged position or the released position.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
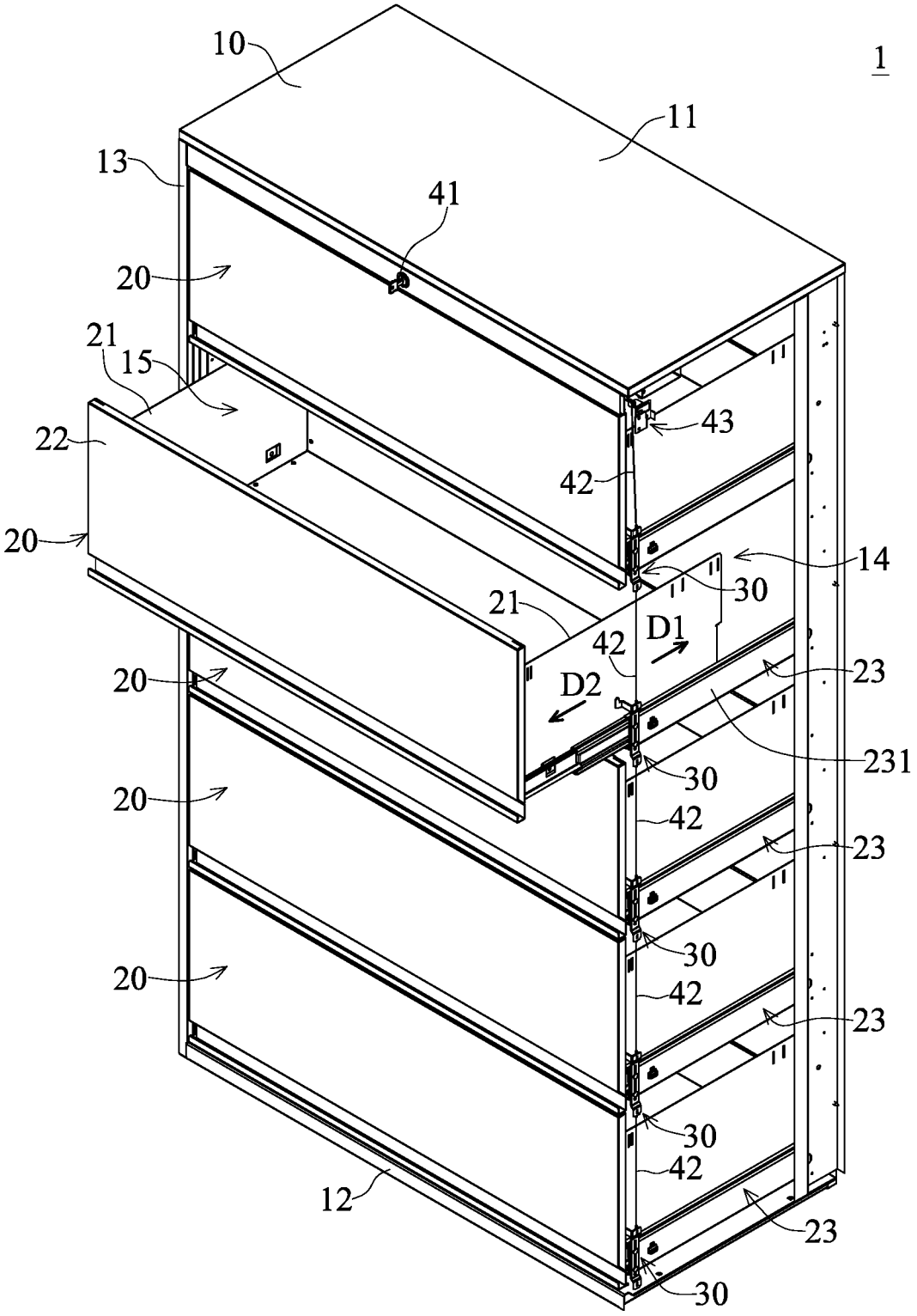
FIG. 1 is a perspective view of a cabinet locking device according to an embodiment of the present disclosure with a side plate of a cabinet body is removed.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 10, the present embodiment discloses a cabinet locking device 1 which includes a cabinet body 10, a plurality of movable storage devices 20, a plurality of locking devices 30, and a driving device 40.

Referring to FIG. 1, the cabinet body 10 has a top plate 11, a bottom plate 12, and two opposite side plates 13. An interior of the cabinet body 10 has an accommodating space 14, and a front side of the cabinet body 10 has an opening end 15. The movable storage devices 20 can be placed into the accommodating space 14 from the open end 15 of the cabinet body 10.

The movable storage devices 20 are parallel with each other and are disposed in the accommodation space 14. Each of the movable storage devices 20 has two side portions 21 that are adjacent to the two side plates 13 of the cabinet body 10. A side of each of the movable storage devices 20 facing towards the front side of the cabinet body 10 has a front side panel 22. The two side portions 21 of each of the movable storage devices 20 are respectively connected to inner side walls of the two side plates 13 of the cabinet body 10 via two slide rails 23. Each of the slide rails 23 includes an outer rail 231 and an inner rail 232, in which the inner rails 232 of the two slide rails 23 are respectively fixed to the two side portions 21 of the corresponding movable storage device 20, and the outer rails 231 of the two slide rails 23 are respectively fixed to the inner side walls of the two side plates 13 of the cabinet body 10. Each of the outer rails 231 is movably sleeved on the corresponding inner rail 232. Therefore, each of the movable storage devices 20 can reciprocate along a straight path by the two corresponding slide rails 23. More specifically, each of the movable storage devices 20 disposed inside the accommodating space 14 of the cabinet body 10 can move along a first direction D1 to a closed position such that the movable storage device 20 is disposed inside the accommodating space 14 of the cabinet body 10; and each of the movable storage devices 20 can move along a second direction D2 opposite to the first direction D1 to an open position such that the movable storage device 20 protrudes from the accommodating space 14.

Referring to FIG. 1, in the present embodiment, a width of the front side panel 22 of each of the movable storage devices 20 is greater than a distance between the two side portions 21 thereof, such that two side edges of the front side panel 22 of each of the movable storage devices 20 that are adjacent to the two side plates 13 protrude from the outer sides of the two side portions 21 thereof.

Figure 4:
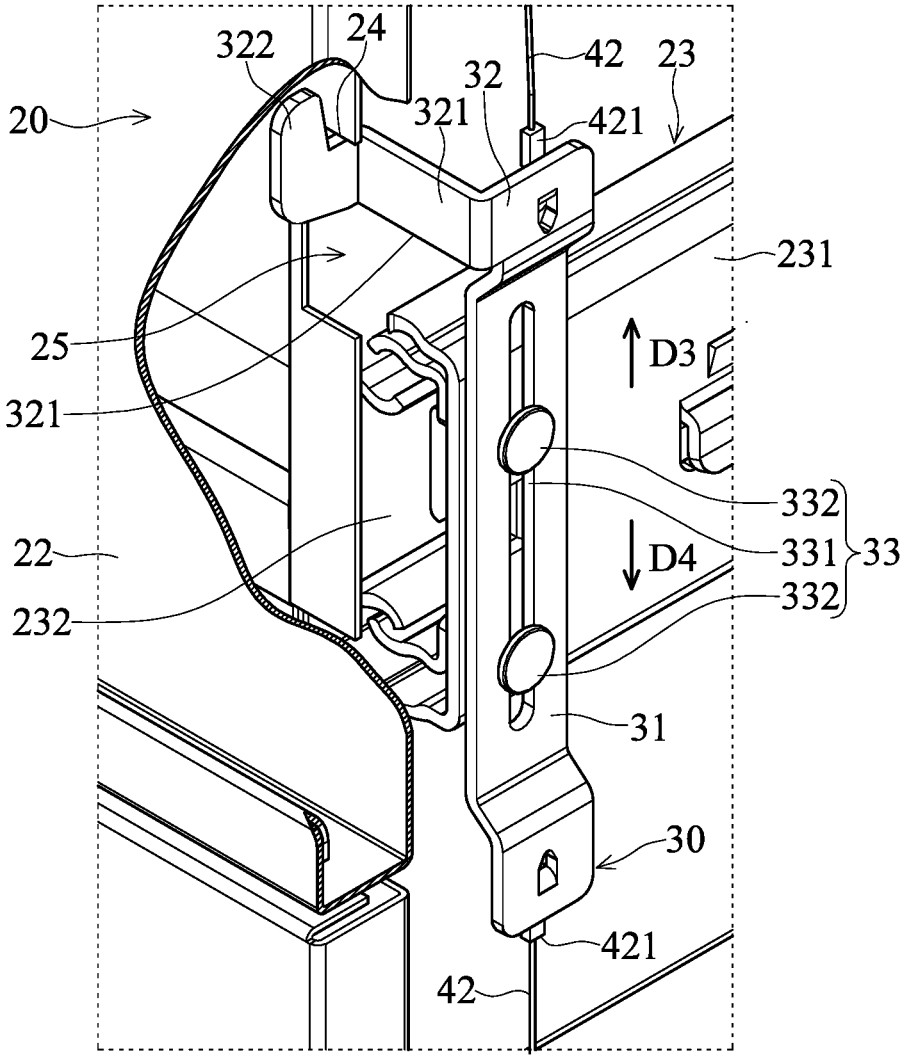
FIG. 4 is a partial perspective view of an engagement structure of the locking device and a movable storage device of the cabinet locking device according to the embodiment of the present disclosure.
Figure 5:
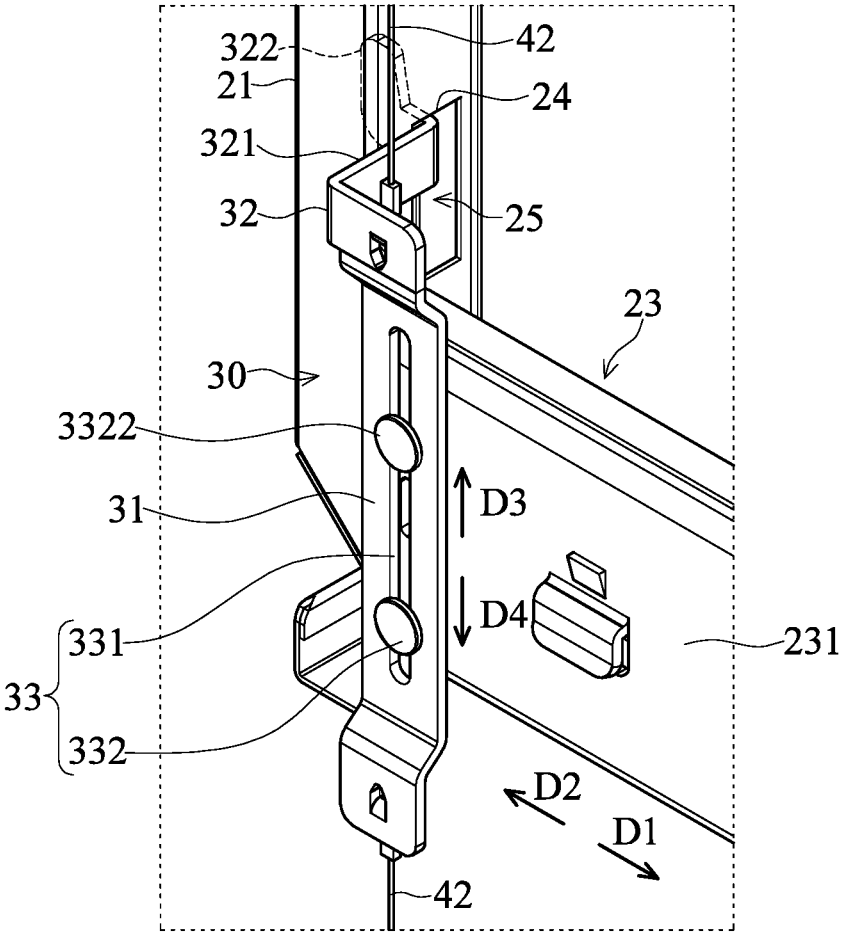
FIG. 5 is another partial perspective view of the engagement structure of the locking device and the movable storage device of the cabinet locking device according to the embodiment of the present disclosure.

Referring to FIG. 4 and FIG. 5, at least one of the two side edges of the front side panel 22 of each of the movable storage devices 20 that are adjacent to the two side plates 13 is provided with at least one notch portion 25 which has a rectangular shape and faces towards the first direction D1. Each of the movable storage devices 20 further includes an engaging portion 24 formed on a side edge of the notch portion 25 facing towards a third direction D3 indicated in FIG. 4 and FIG. 5.

Figure 2:
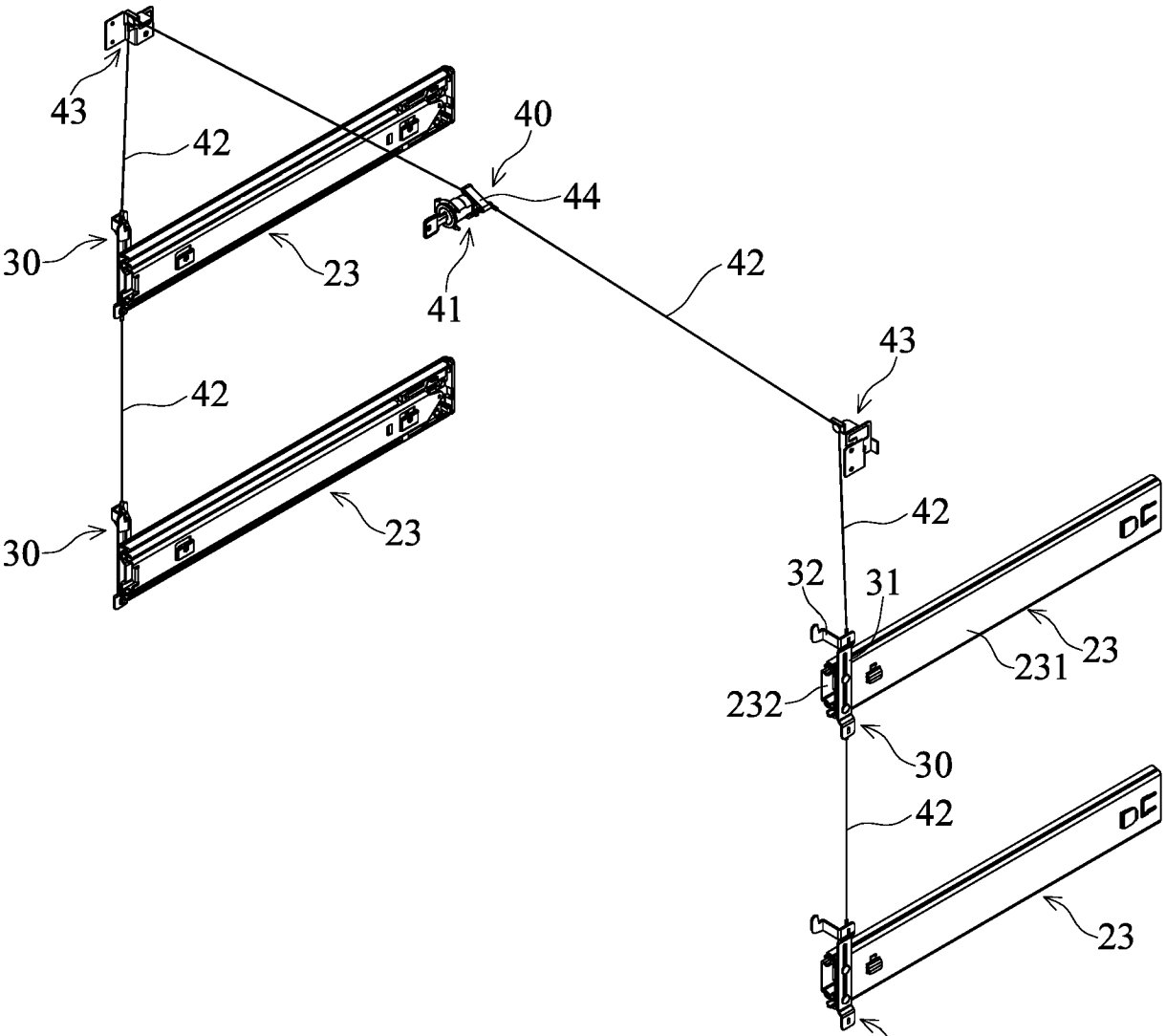
FIG. 2 is a partial perspective view of an assembly of a driving device and a locking device of the cabinet locking device according to the embodiment of the present disclosure.
Figure 3:
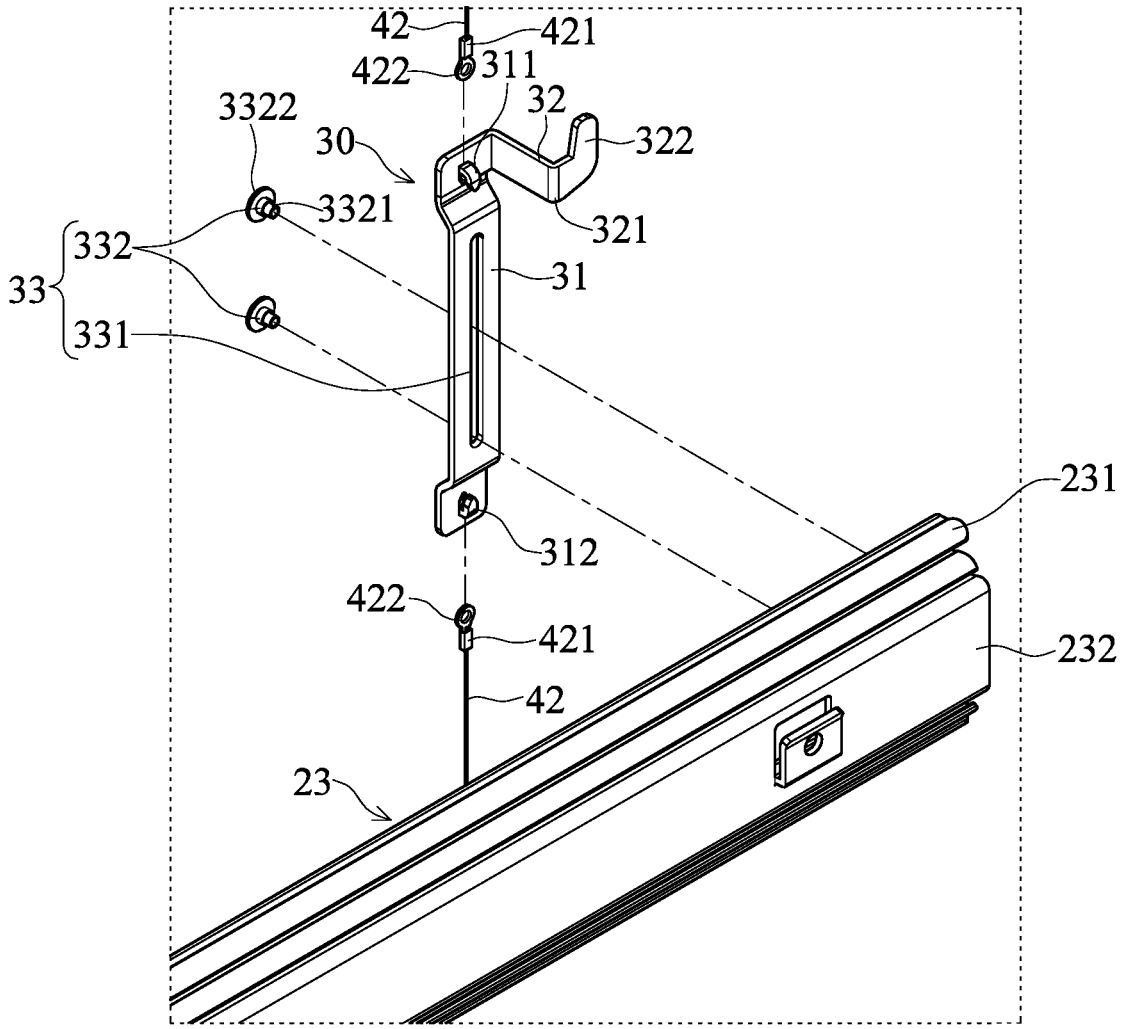
FIG. 3 is an exploded view of the locking device and a slide rail of the cabinet locking device according to the embodiment of the present disclosure.
Figure 9:
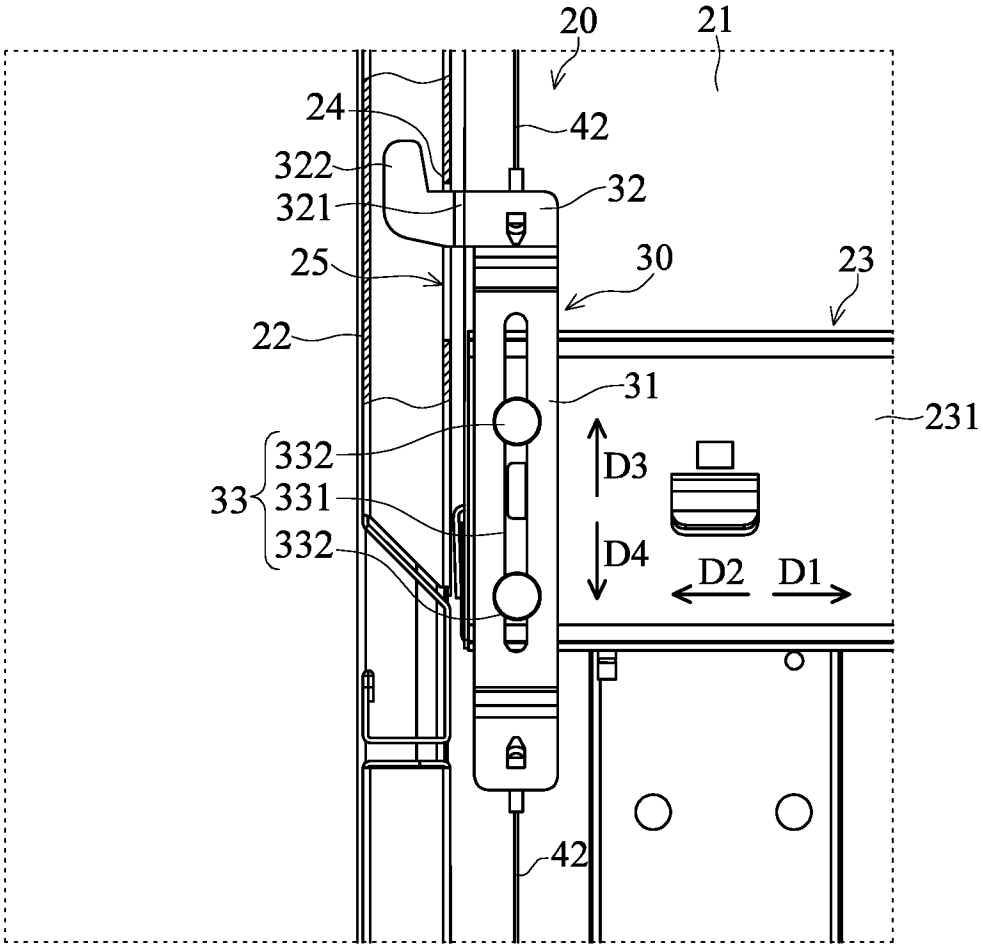
FIG. 9 and FIG. 10 are schematic views showing the operation of the locking device according to the embodiment of the present disclosure.
Figure 10:
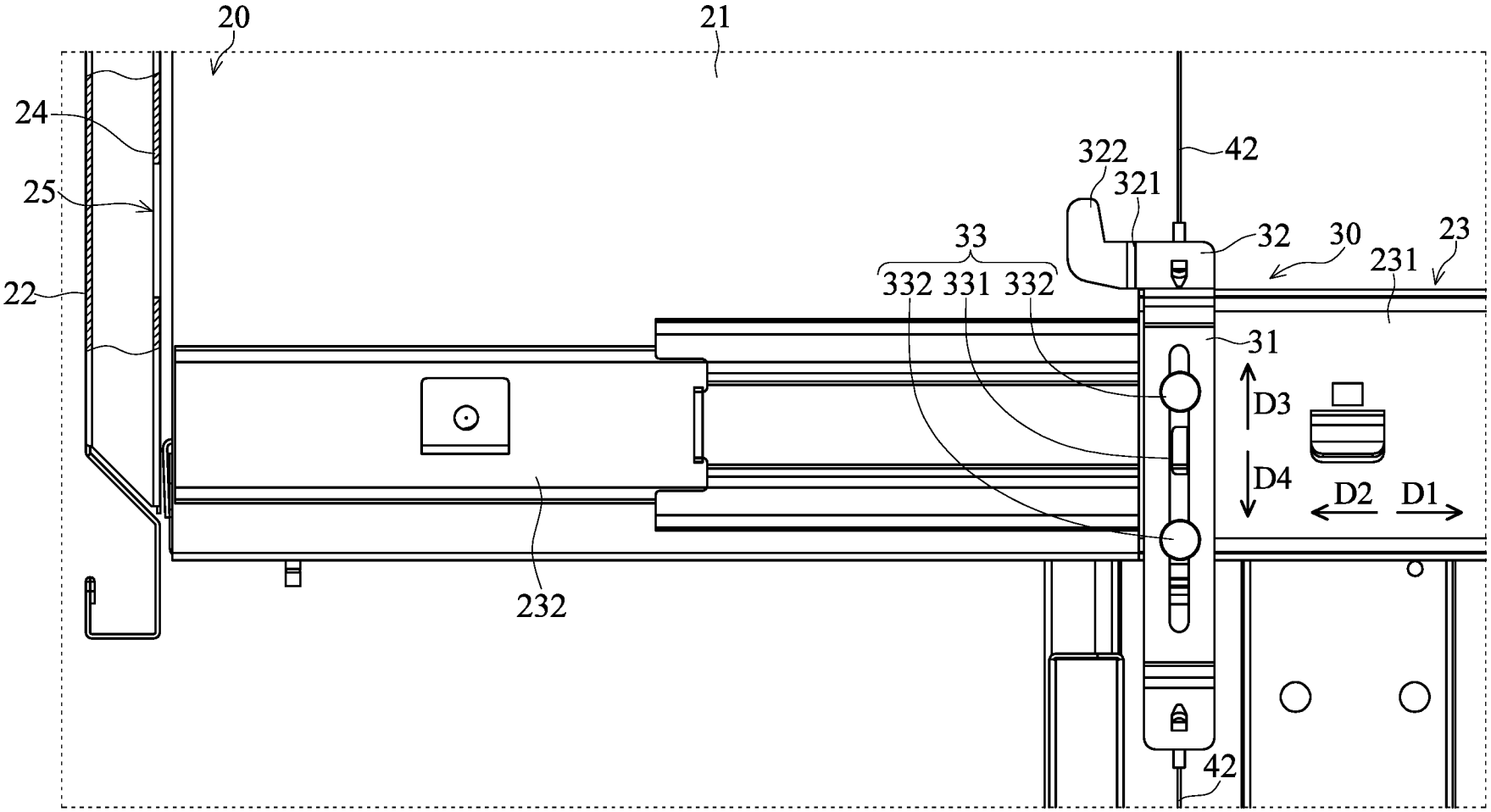

Referring to FIG. 1 to FIG. 5, the locking devices 30 are disposed inside the cabinet body 10 and respectively adjacent to the engaging portions 24. Referring to FIG. 3 to FIG. 5, in the present embodiment, each of the locking devices 30 includes a sliding member 31, an interference member 32, and a restriction mechanism 33. In each of the locking devices 30, the sliding member 31 is a plate body with a substantially elongated shape, and the sliding member 31 is mounted to the corresponding outer rail 231 via the restriction mechanism 33. The sliding member 31 is configured to be guided by the restriction mechanism 33 to move to an engaged position along a third direction D3 perpendicular to the first direction D1 or the second direction D2 as shown in FIG. 9; or the sliding member 31 is configured to be guided by the restriction mechanism 33 to move to a released position along a fourth direction D4 opposite to the third direction D3 as shown in FIG. 10. As shown in FIG. 3, in each of the locking devices 30, a first hook 311 is provided at one end of the sliding member 31 facing towards the third direction D3, and a second hook 312 is provided at the other end of the sliding member 31 facing towards the fourth direction D4. The first hook 311 and the second hook 312 are connected to drawstrings 42 of the driving device 40 so that the sliding member 31 can be driven by the driving device 40 to move to the engaged position or the released position.

Referring to FIG. 3 to FIG. 5, in each of the locking devices 30, the interference member 32 is connected to the end of the sliding member 31 facing towards the third direction D3. The interference member 32 has a connecting arm 321 and an interference portion 322. One end of the connecting arm 321 close to the sliding member 31 is connected to the sliding member 31. The other end of the connecting arm 321 away from the sliding member 31 extends towards a position corresponding to the notch portion 25 located at the back surface of the front side panel 22. The interference portion 322 is integrally connected to the other end of the connecting arm 321 away from the sliding member 31. The interference portion 322 is a hook body that protrudes from the other end of the connecting arm 321 away from the sliding member 31, extends towards the second direction D2, and is bent toward the third direction D3.

Referring to FIG. 4, FIG. 5, FIG. 9, and FIG. 10, in each of the locking devices 30 and the corresponding movable storage device 20, the position of the interference portion 322 of the interference member 32 is arranged at a position where the interference portion 322 interferes with the engaging portion 24 when the movable storage device 20 is moved to the closed position and the sliding member 31 is moved to the engaged position; or is arranged at a position where the interference portion 322 does not interfere with the engaging portion 24 when the sliding member 31 is moved to the released position.

More specifically, as shown in FIG. 9, when the movable storage device 20 is moved to the closed position and the sliding member 31 is moved to the engaged position, the interference portion 322 extends into the notch portion 25 along the second direction D2 and is engaged with one side of the engaging portion 24 facing towards the second direction D2 such that the interference member 32 interferes with the engaging portion 24 to restrict the movement of the movable storage device 20 toward the second direction D2. As shown in FIG. 10, when the sliding member 31 and the interference member 32 are moved to the released position, a height of a top end of the interference portion 322 is lower than that of the engaging portion 24 such that the interference member 32 does not interfere with the engaging portion 24.

Referring to FIG. 3 to FIG. 5, the restriction mechanism 33 of each of the locking devices 30 includes a guiding slot 331 and two limiting posts 332. The guiding slot 331 is an elongated hole formed on the sliding member 31, and the two limiting posts 332 are configured to be inserted into the guiding slot 331. The two limiting posts 332 are arranged along a long axis direction of the guiding slot 331 that is parallel to the third direction D3 or the fourth direction D4. Therefore, the restriction mechanism 33 is capable of guiding the sliding member 31 to reciprocate along the third direction D3 or the fourth direction D4.

Each of the limiting posts 332 has a columnar body 3321 and a stopping flange 3322 connected to an end of the columnar body 3321. A diameter of the columnar body 3321 is slightly smaller than a width of the guiding slot 331 such that the columnar body 3321 is slidably disposed in the guiding slot 331. A diameter of the stopping flange 3322 is greater than a width of the guiding slot 331 such that the stopping flange 3322 is engaged with an edge of the guiding slot 331 to prevent the limiting post 332 from being detached from the guiding slot 331.

Referring to FIG. 1 and FIG. 2, the driving device 40 includes a traction mechanism 41, a plurality of drawstrings 42, and a plurality of winding members 43. The traction mechanism 41 is disposed at a top end of the cabinet body 10, and the traction mechanism 41 is interlocked with the locking devices 30 via the drawstrings 42 to enable the traction mechanism 41 to drive the locking devices 30 via the drawstrings 42.

Figure 6:
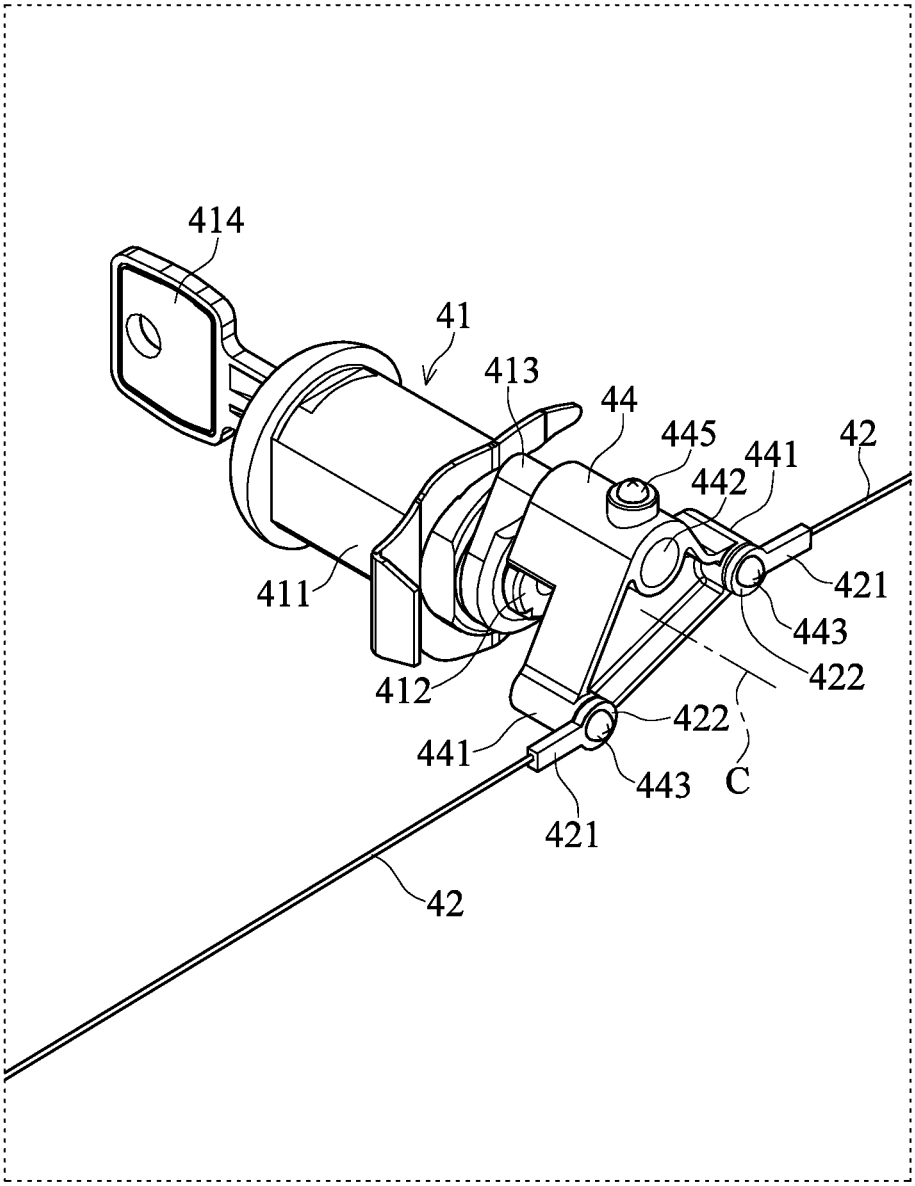
FIG. 6 is a partial perspective view of the cabinet locking device adopting a driving device according to the embodiment of the present disclosure.
Figure 7:
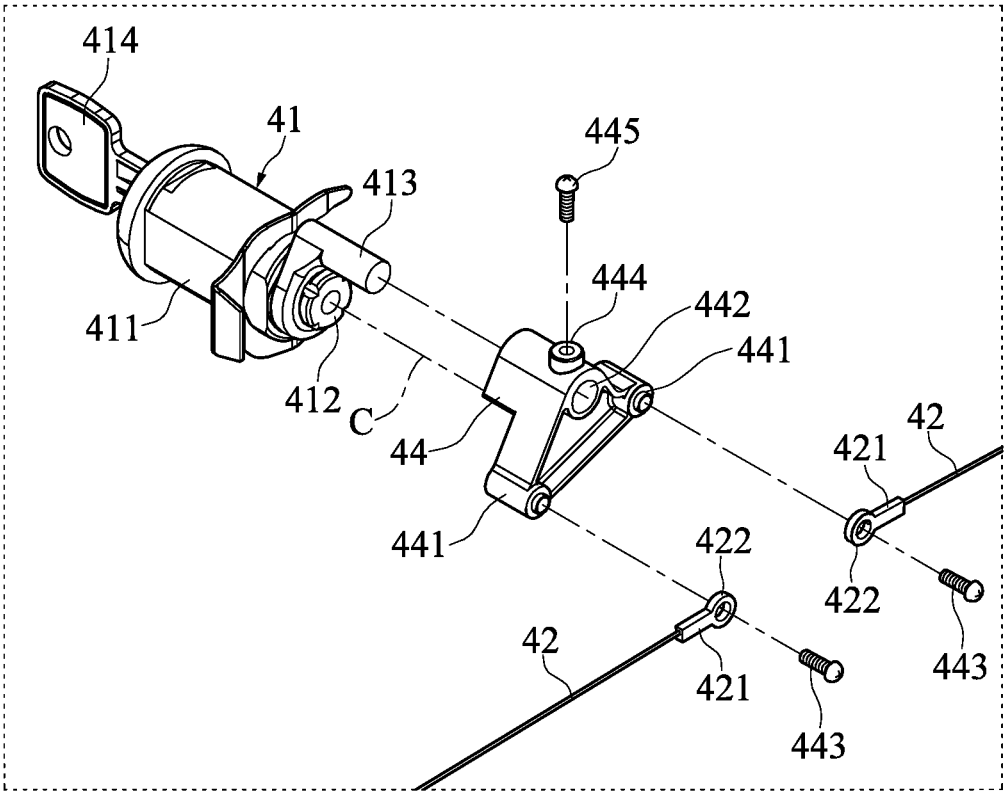
FIG. 7 is an exploded view of FIG. 6.

Referring to FIG. 6 and FIG. 7, in the present embodiment, the traction mechanism 41 includes a lock core 411 and an adapter 44. The lock core 411 has a rotary bearing 412 and is configured to be inserted with a key 414. A user can use the key 414 to unlock the lock core 411 and further use the key 414 to rotate the rotary bearing 412 of the lock core 411. Moreover, one side of the rotary bearing 412 is provided with a connecting post 413, the adapter 44 has a plug hole 442, and the plug hole 442 is configured to be plugged by the connecting post 413 such that the adapter 44 is fixedly connected to the rotary bearing 412. One side face of the adapter 44 has a retaining screw hole 444, and the retaining screw hole 444 is configured to be threadedly engaged by a retaining screw 445 so that after the retaining screw hole 444 is threadedly engaged by the retaining screw 445, the retaining screw 445 abuts against the connecting post 413 to prevent the connecting post 413 from being detached from the plug hole 442.

The adapter 44 is fixedly connected to the rotary bearing 412 by virtue of the plug hole 442 being plugged by the connecting post 413. Accordingly, when the rotary bearing 412 of the lock core 411 is rotated, the adapter 44 is driven to rotate with respect to a central axis C of the lock core 411. Two side edges of the adapter 44 each have a connecting portion 441, and axes of the two connecting portions 441 are different in position from the central axis C of the rotary bearing 412. Each of the connecting portions 441 has a screw hole, and the screw hole of each of the connecting portions 441 is configured to be threadedly engaged by a screw 443. Ends of the two adjacent drawstrings 42 close to the adapter 4 are fixedly connected to the two connecting portions 441 via the two screws 443. Therefore, when the adapter 44 is swung, the adapter 44 is configured to pull the two adjacent drawstrings 42 through the two connecting portions 441, thereby driving the locking devices 30 through the drawstrings 42.

Referring to FIG. 2 and FIG. 3, in the present embodiment, two ends of each of the drawstrings 42 each include a fixing portion 421 and a ring portion 422 formed on the fixing portion 421. Each of the drawstrings 42 is interlocked with the traction mechanism 41 and the locking devices 30 via the two ring portions 422 thereof, such that the traction mechanism 41 can drive the locking devices 30 via the drawstrings 42. Referring to FIG. 6 and FIG. 7, in all the drawstrings 42, the ring portions 422 of the two adjacent drawstrings 42 closest to the traction mechanism 41 are fixedly connected to the two connecting portions 441 of the adapter 44 via the two screws 443, such that the ends of the two adjacent drawstrings 42 closest to the traction mechanism 41 are fixedly connected to the adapter 44. Referring to FIG. 3 and FIG. 4, the two ring portions 422 of each of the drawstrings 42 are configured to be fixedly connected to the first hook 311 or the second hook 312 of the sliding member 31, such that the two ends of each of the drawstrings 42 can be respectively and fixedly connected to the sliding members 31 of the two adjacent locking devices 30.

Figure 8:
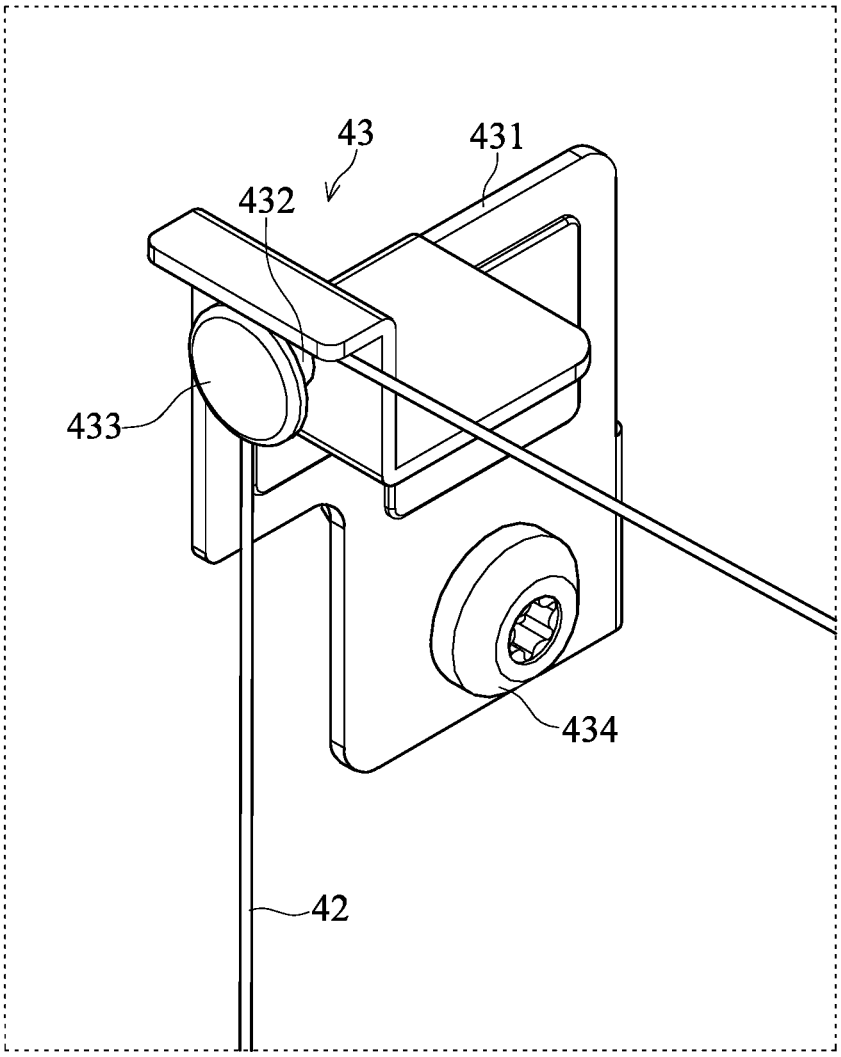
FIG. 8 is a partial perspective view of the cabinet locking device adopting a winding member according to the embodiment of the present disclosure.

Referring to FIG. 1, FIG. 2 and FIG. 8, in the present embodiment, the driving device 40 further includes a plurality of winding members 43 for guiding moving paths of the drawstrings 42. The winding members 43 are respectively disposed at positions inside the cabinet body 10 between the traction mechanism 41 and the locking devices 30. Each of the winding members 43 has a fixing base 431, a winding post 432, and a flange portion 433. Referring to FIG. 8, in each of the winding members 43, the fixing base 431 is configured to be fixedly connected to the inner wall of the cabinet body 10 via a screw 434. The winding post 432 is substantially cylindrical, and one end of the winding post 432 is connected to the fixing base 431. The flange portion 433 is fixed on the other end of the winding post 432 away from the fixing base 431, and a diameter of the flange portion 433 is greater than a diameter of the winding post 432. One of the drawstrings 42 is configured to be wound around the winding post 432 and configured to slide on the surface of the winding post 432. When the drawstring 42 is wound around the winding post 432, the drawstring 42 is located and engaged between the flange portion 433 and the fixing base 431 to prevent the drawstring 42 from being detached from the winding post 432. The winding members 43 are configured to be respectively disposed at turning points of the moving paths of the drawstrings 42 to position the drawstrings 42 and to guide the moving paths of the drawstrings 42.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A cabinet locking device, comprising:

a cabinet body, an interior of the cabinet body having an accommodating space, a front side of the cabinet body having an opening end, and the left and right sides of the cabinet body each including a side plate;

at least one movable storage device, two side portions of the movable storage device adjacent to the two side plates being respectively mounted to inner side walls of the two side plates via two slide rails; wherein the movable storage device is capable of moving along a first direction to a closed position by the guiding of the two slide rails so that the movable storage device is disposed inside the accommodating space, and the movable storage device is capable of moving along a second direction opposite to the first direction to an open position by the guidance of the two slide rails such that the movable storage device protrudes from the accommodating space; wherein at least one of the two side portions of the movable storage device adjacent to the two side plates has at least one engaging portion;

at least one locking device, the locking device being disposed inside the cabinet body and being adjacent to the engaging portion; wherein the locking device includes a sliding member, an interference member connected to the sliding member, and a restriction mechanism configured to limit a displacement path of the sliding member; wherein the sliding member is configured to be guided by the restriction mechanism to move to an engaged position along a third direction perpendicular to the first direction or the second direction; or the sliding member is configured to be guided by the restriction mechanism to move to a released position along a fourth direction opposite to the third direction; wherein the position of the interference member is arranged at a position where the interference member interferes with the engaging portion when the movable storage device is moved to the closed position and the sliding member is moved to the engaged position; or is arranged at a position where the interference member does not interfere with the engaging portion when the sliding member is moved to the released position; and a driving device, the driving device including a traction mechanism and at least one drawstring that is interlocked with the traction mechanism and the sliding member; wherein the traction mechanism is configured to drive the sliding member to move along the third direction or the fourth direction via the drawstring, such that the sliding member moves to the engaging portion or the released position.

2. The cabinet locking device according to claim 1, wherein the two slide rails each include an outer rail and an inner rail, the two outer rails are respectively and movably sleeved on the two inner rails, the two outer rails are respectively disposed on the inner side walls of the two side plates of the cabinet body, the two inner rails are respectively disposed on the two side portions of the movable storage device that are adjacent to the two side plates, and the locking device is disposed on one of the two outer rails.

3. The cabinet locking device according to claim 2, wherein the restriction mechanism of the locking device includes a guiding slot formed on the sliding member and two limiting posts disposed on the corresponding outer rail and slidably inserted into the guiding slot; the two limiting posts are arranged along a long axis direction of the guiding slot, and the long axis direction of the guiding slot are parallel to the third direction or the fourth direction.

4. The cabinet locking device according to claim 1, wherein the interference member is integrally connected to the sliding member, the interference member includes a connecting arm and an interference portion, one end of the connecting arm close to the sliding member is connected to the sliding member, the other end of the connecting arm away from the sliding member extends towards a position corresponding to a notch portion, and the interference portion is formed on the other end of the connecting arm away from the sliding member.

5. The cabinet locking device according to claim 4, wherein the interference portion is a hook body that protrudes from the other end of the connecting arm away from the sliding member, extends towards the second direction, and is bent towards the third direction.

6. The cabinet locking device according to claim 5, wherein a side of the movable storage device facing towards the second direction has a front side panel, two side edges of the front side panel adjacent to the two side plates respectively protrude from the two side portions of the movable storage device, at least one of the two side edges of the front side panel adjacent to the two side plates is provided with at least one notch portion that faces towards the first direction, and the engaging portion of the movable storage device is formed on a side edge of the notch portion facing towards the third direction; wherein when the movable storage device is moved to the closed position and the sliding member is moved to the engaged position, the interference portion extends into the notch portion along the second direction and is engaged with one side of the engaging portion facing towards the second direction.

7. The cabinet locking device according to claim 1, wherein the traction mechanism includes a lock core and an adapter, the lock core has a rotary bearing and is configured to be inserted by a key, the rotary bearing is capable of being rotatingly driven by the key, and the adapter disposed on the rotary bearing has at least a connecting portion; an axe of the connecting portion is different in position from a central axis of the rotary bearing, and one end of the drawstring close to the traction mechanism is connected to the connecting portion.

8. The cabinet locking device according to claim 7, wherein two ends of the drawstring each includes a ring portion; and the two ends of the drawstring are respectively connected to the adapter or the sliding member by the two ring portions.

9. The cabinet locking device according to claim 8, wherein one end of the sliding member facing towards the third direction is provided with a first hook, the other end of the sliding member facing towards the fourth direction is provided with a second hook, and the first hook and the second hook are configured to be connected to the two ring portions of the drawstring.

10. The cabinet locking device according to claim 1, wherein the driving device further includes at least one winding member, the winding member is disposed at the position of the inside of the cabinet body between the traction mechanism and the locking device, the winding member has a winding post, and the drawstring is configured to be wound around the winding post.

* * * * *